US005252794A

United States Patent [19]

Tseng

[11] Patent Number: 5,252,794

[45] Date of Patent: Oct. 12, 1993

[54] CONDUCTIVE SPINDLE ASSEMBLY OF PULL SWITCH

[76] Inventor: Tien-Fu Tseng, 9F-3, No. 218 Kuo Kuang Rd., Taichung, Taiwan

[21] Appl. No.: 921,101

[22] Filed: Jul. 29, 1992

[51] Int. Cl.[5] ..... H01H 17/06

[52] U.S. Cl. ..... 200/51.15; 200/11 A; 200/544

[58] Field of Search ..... 200/544, 546, 51.15, 200/413, 420, 11 A

[56] References Cited

U.S. PATENT DOCUMENTS

| | | | |
|---|---|---|---|
| 2,240,200 | 4/1941 | Young et al. | 200/51.15 |
| 2,988,606 | 6/1961 | Allison | 200/11 A |
| 4,572,931 | 2/1986 | Shiraishi et al. | 200/11 A |

*Primary Examiner*—Renee S. Luebke

*Attorney, Agent, or Firm*—Morton J. Rosenberg; David I. Klein

[57] ABSTRACT

This invention provides a conductive spindle assembly of a pull switch which has an insulation spindle within which is formed three recesses in a periphery of the insulation spindle. A conductive collar is provided for matingly engaging with the insulation spindle. The conductive collar has a conductive base portion and three vertically extending conductive contact tabs. The first and second of the contact tabs extend vertically from a periphery of the base portion and have a first vertical extension height. The third contact tab extends vertically from the base portion and has a second vertical extension height greater than the vertical extension height of the first and second contact tabs. Each of the three tabs is insertable within the recesses of the insulation spindle in a manner providing for the periphery of the spindle assembly to have a substantially continuous cylindrical surface.

2 Claims, 8 Drawing Sheets

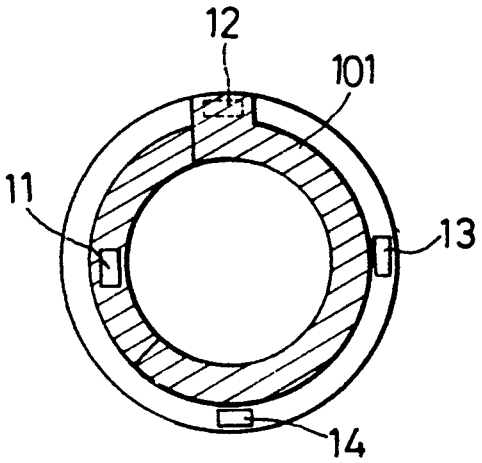
FIG.2-a
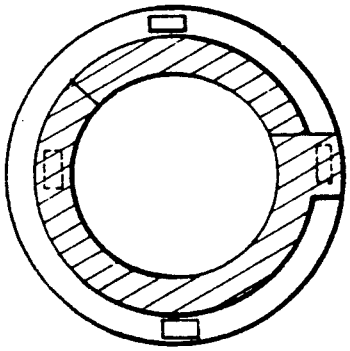
FIG.2-b
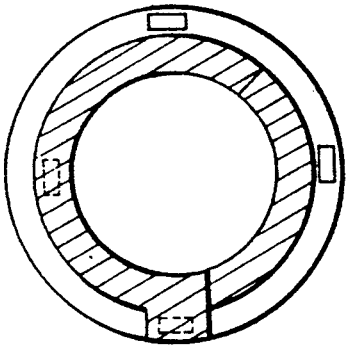
FIG.2-c
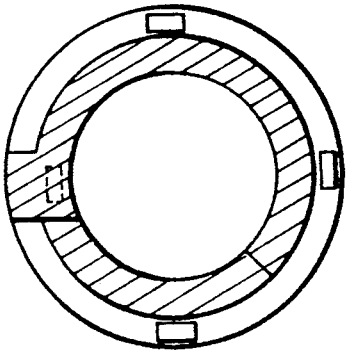
FIG.2-d
PRIOR ART

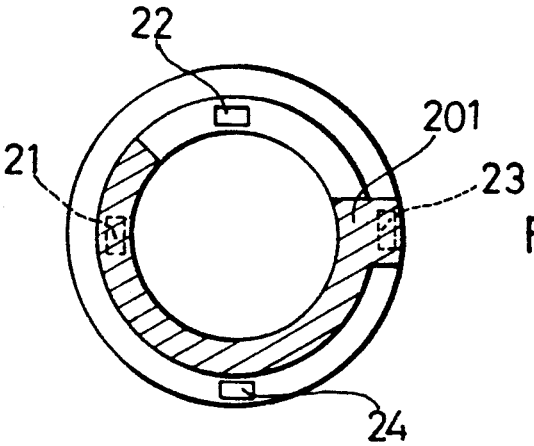
FIG. 4-a
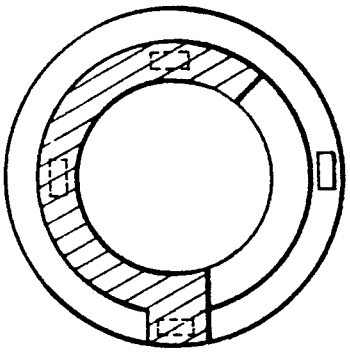
FIG. 4-b
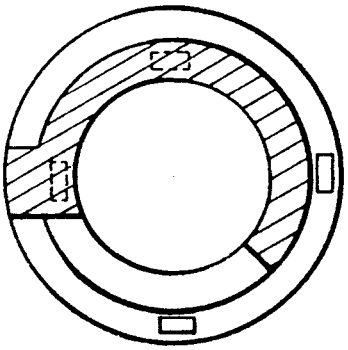
FIG. 4-c
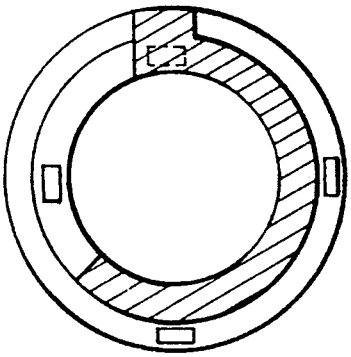
FIG. 4-d
PRIOR ART

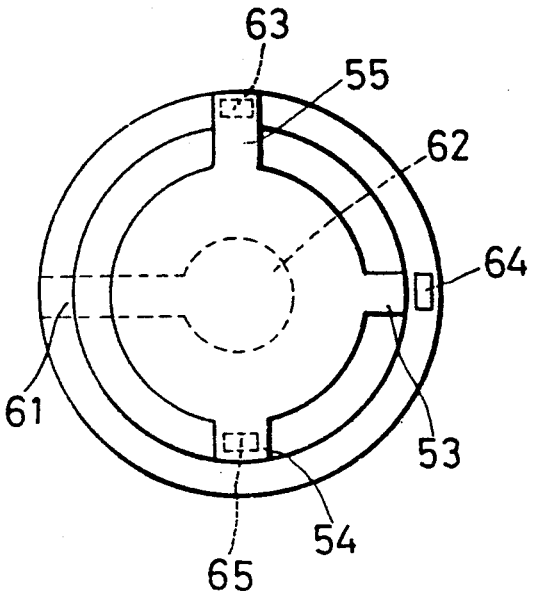
FIG.6-a
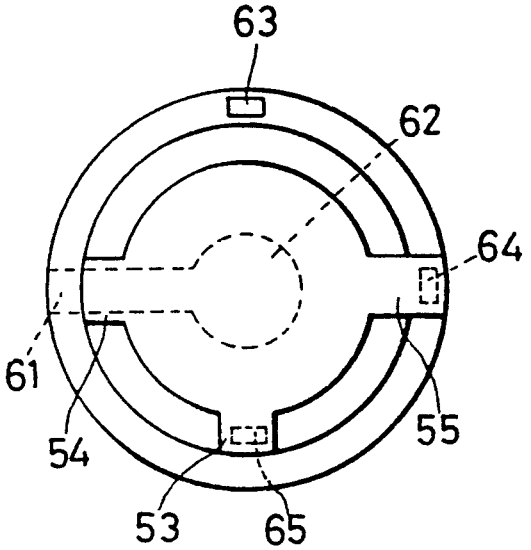
FIG.6-b
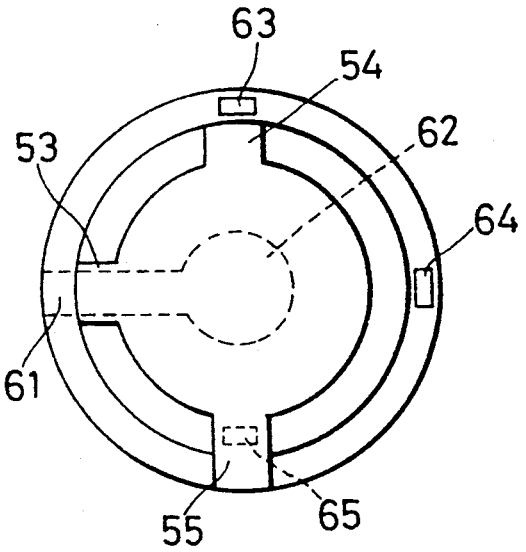
FIG.6-c
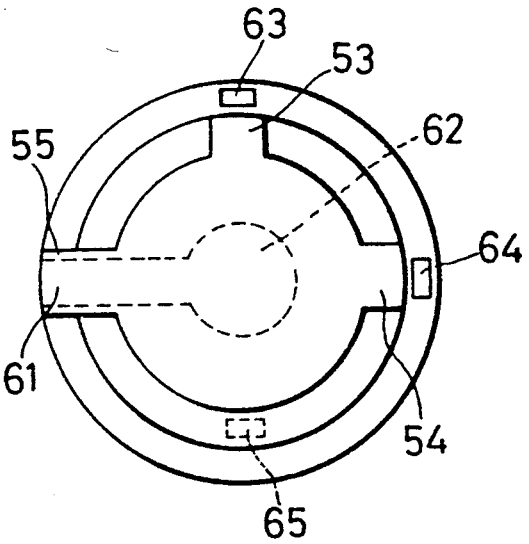
FIG.6-d

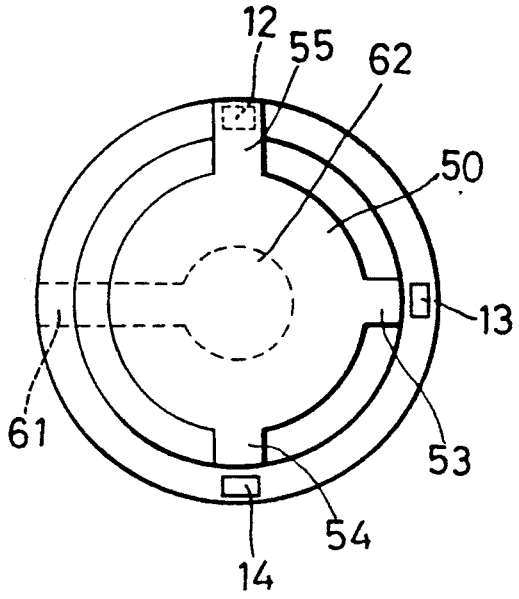
FIG.7-a
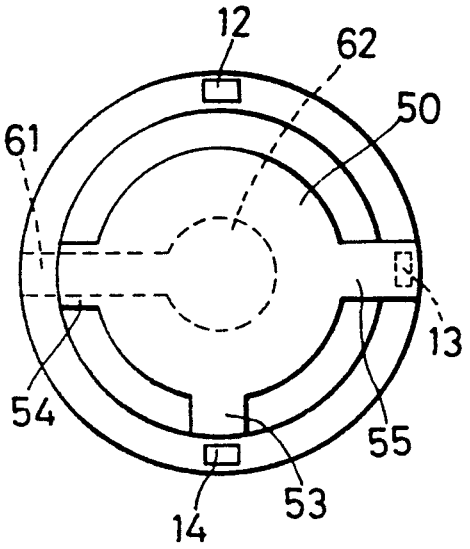
FIG.7-b
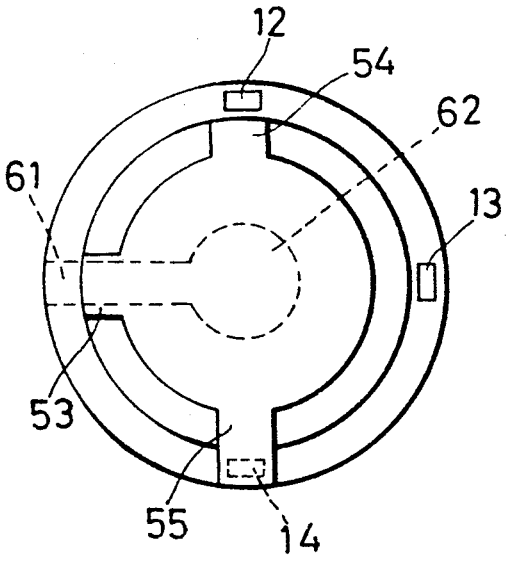
FIG.7-c
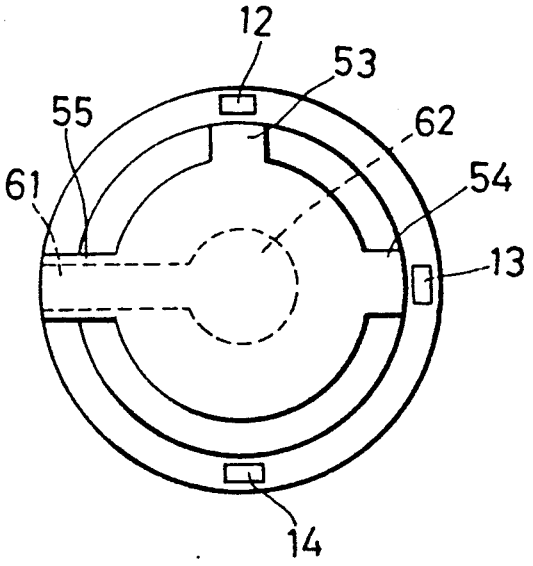
FIG.7-d

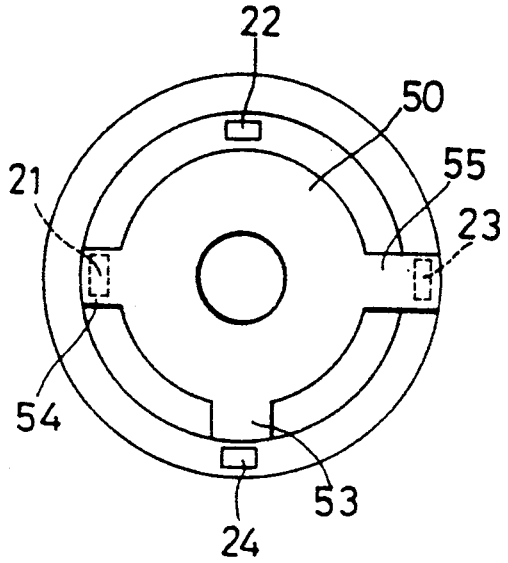
FIG.8-a
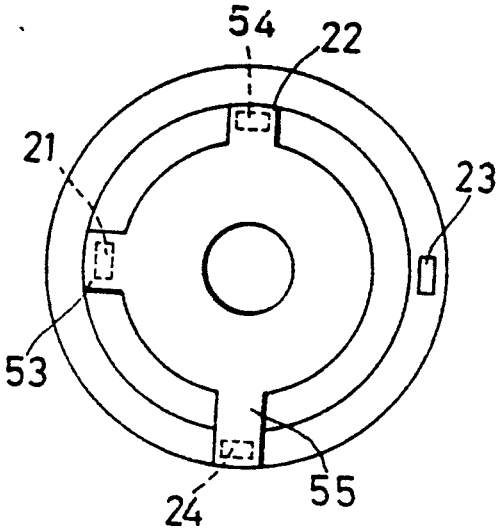
FIG.8-b
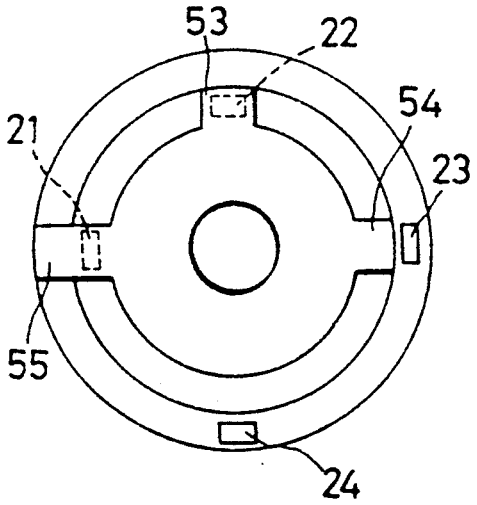
FIG.8-c
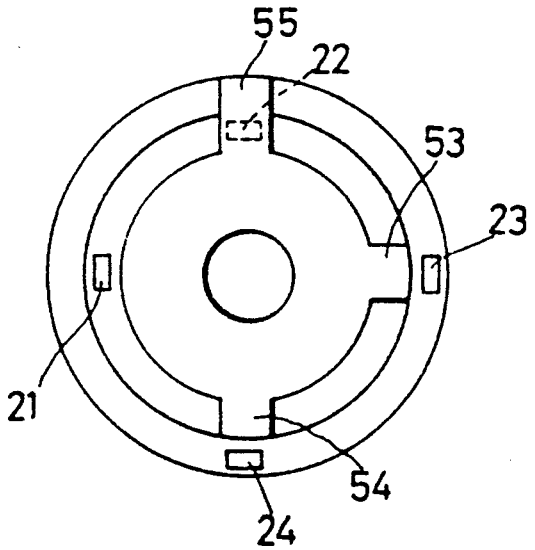
FIG.8-d

CONDUCTIVE SPINDLE ASSEMBLY OF PULL SWITCH

BACKGROUND OF THE INVENTION

The present invention relates to an insulation spindle for a pull switch, and more particularly to a conductive spindle assembly which can be used in several kinds of pull switches.

Pull switches are commonly used to control the change of speeds of a ceiling fan. It is not easy to make a pull switch comprising a base provided with a plurality of wiring grooves. Therefore, a conventional pull switch of the prior art is provided with three positions for three different speeds in addition to a disconnection position. In order to reduce the cost of the pull switches of the prior art by means of a reduction in number of the capacitors and to facilitate the switching of speeds, the prior art switches have been designed in various ways to meet the requirements for a variety of the switching modes.

As shown in FIG. 1, a pull switch 1 of the prior art comprises three positions for three different speeds and a disconnection position. Such a pull switch is capable of changing speeds due to the fact that it includes a conductive piece which is located at a lower level to contact with one of three other conductive pieces located at a higher level. This allows the switch to connect with capacitors of various capacitances. The insulation spindle 10 is provided with a conductive collar 101, as shown in FIG. 2-*a*. The conductive piece 11 is situated at a lower level while the conductive pieces 12, 13 and 14 are located at a higher level, as shown in FIG. 2-*a* wherein the conductive piece 11 is in conduction with the first conductive piece 12. When the insulation spindle 10 is turned to the position as shown in FIG. 2-*b*, the conductive piece 11 is in conduction with the second conductive piece 13. When the insulation spindle 10 is turned again to the position as shown in FIG. 2-*c*, the conductive piece 11 is in conduction with the third conductive piece 14. When the insulation spindle 10 is turned further to the position as shown in FIG. 2-*d*, the conductive piece 11 is no longer in conduction with any of the three conductive pieces at the higher level, thereby resulting in a disconnection position.

Now referring to FIG. 3, a pull switch 2 of the prior art comprises an insulation spindle 20 with a conductive collar 201, two conductive pieces 21 and 22 located at a lower level, and two other conductive pieces 23 and 24 located at a higher level. In FIG. 4-*a*, the conductive piece 21 is in conduction with the conductive piece 23. When the insulation spindle 20 together with the conductive collar 201 is turned to the position as shown in FIG. 4-*b*, the conductive piece 21 is in conduction with the conductive pieces 22 and 24. When the insulation spindle 20 together with the conductive collar 201 is turned again to the position as shown in FIG. 4-*c*, the conductive piece 21 is in conduction with the conductive piece 22. When the insulation spindle 20 together with the conductive collar 201 is turn further to the position as shown in FIG. 4-*d*, the conductive piece 21 is no longer in conduction with any of the other three conductive pieces, thereby resulting in a disconnection position.

From the above description, it can be known that the two different kinds of conventional pull switches use the different kinds of insulation spindles and conductive collars.

The primary object of the present invention is to provide a conductive spindle assembly which can be used in several kinds of pull switches including the two kinds of prior art switches so that by use of the conductive spindle assembly in accordance with the invention, the costs for storing, handling, and manufacturing different kinds of insulation spindles and conductive collars can be saved.

SUMMARY OF THE INVENTION

A pull switch incorporating the conductive spindle assembly in accordance this invention comprises a pull case and a base. An actuation disk and a torsional spring (not shown) are provided in the pull case. One end of a bead chain is attached to the actuation disk and the other end of the bead chain is extended out from a through hole. The actuation disk is provided with an actuation axle extending from the bottom of the pull case for actuating an insulation spindle located centrally in the base having four spaces provided equiangularly. One of the four spaces is provided with a conductive wire retaining portion connected with a conductive contact portion extending toward the center of the base, while the other three spaces are provided respectively with three conductive pieces, each of which has an outer end for connection with a lead wire (not shown) and the other end to be in contact with a conductive collar mounted on the periphery of the insulation spindle. In the base, two of said three conductive pieces are located at a higher level and the third conductive piece is located at a lower level. The conductive collar is provided with a first contact tab and a second contact tab, both of which extend from the base of the conductive collar to the lower level, in addition to a third contact tab which extends from the base of the conductive collar to the higher level. On the periphery of the insulation spindle are formed three recesses of appropriate depths for respectively accommodating the three contact tabs so that the periphery of the spindle assembly including the insulation spindle and the conductive collar can constitute a smooth cylindrical surface for contact with said three conductive pieces. The base portion of the conductive collar beneath the bottom of the insulation spindle is pressed against the contact portion which is located at the bottom of the space and connected with the conductive wire retaining portion.

BRIEF DESCRIPTION OF THE DRAWINGS

FIGS. 2-*a*, 2-*b*, 2-*c*, 2-*d* are schematic views showing the conductive states of the pull switch shown in FIG. 1;

FIGS. 4-*a*, 4-*b*, 4-*c*, 4-*d* are schematic views showing the conductive states of the pull switch shown in FIG. 3;

FIGS. 6-*a*, 6-*b*, 6-*c*, 6-*d* are schematic views showing the conductive states of the pull switch shown in FIG. 5;

FIGS. 7-*a*, 7-*b*, 7-*c*, 7-*d* are schematic views showing the conductive states of the pull switch shown in FIG.

1, but the insulation spindle 10, the conductive collar 101, and the conductive piece 11 at the lower level therein are respectively replaced by the insulation spindle 5, the conductive collar 50, and the conductive piece 61 shown in FIG. 5; and FIGS. 8-*a*, 8-*b*, 8-*c*, 8-*d* are schematic views showing the conductive states of the pull switch shown in FIG. 3, but the insulation spindle 20 and the conductive collar 201 therein are replaced by the insulation spindle 5 and the conductive collar 50 shown in FIG. 5.

DETAILED DESCRIPTION OF THE PREFERRED EMBODIMENT

Figure 5:
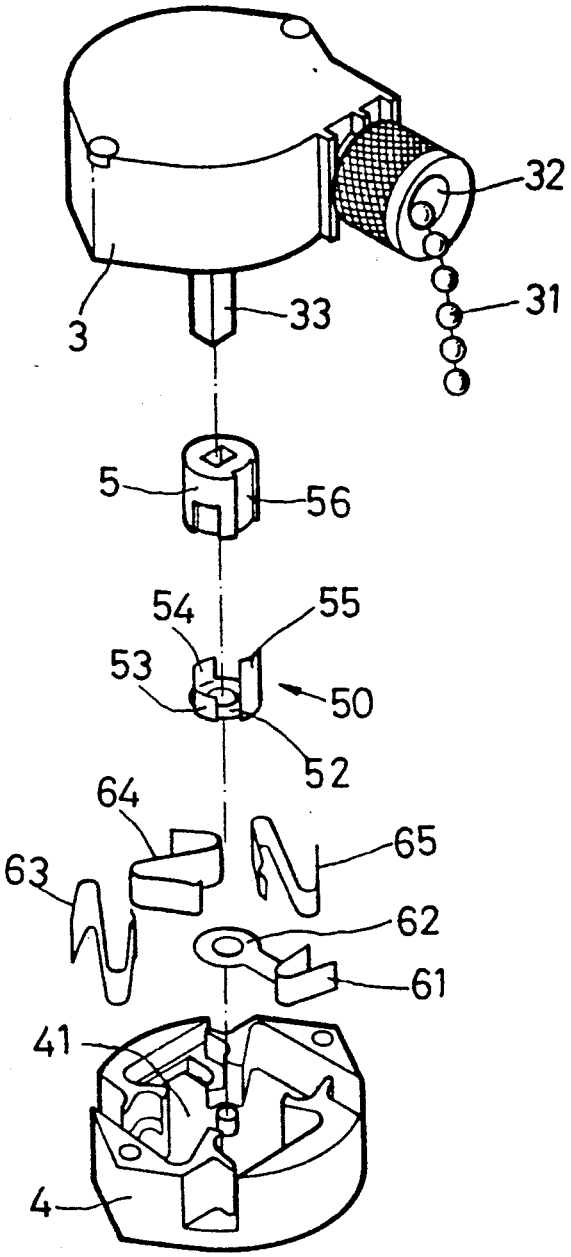
FIG. 5 is an exploded view showing a pull switch incorporating the conductive spindle assembly in accordance with the present invention.

Referring to FIG. 5, a pull switch incorporating the insulation spindle in accordance with this invention comprises a pull case 3 and a base 4. An actuation disk and a torsional spring (not shown) are provided in the pull case 3. One end of a bead chain 31 is attached to the actuation disk and the other end of the bead chain 31 is extended out from a through hole 32. The actuation disk is provided with an actuation axle 33 extending from the bottom of the pull case 3 for actuating a insulation spindle 5 located centrally in the base 4 comprising four spaces 41 provided equiangularly. One of the four spaces 41 is provided with a conductive piece 61 having a contact piece 62 extending toward the center of the base 4, while in the other three spaces 41 are provided respectively with conductive pieces 63, 64 and 65, each of which has an outer end connected with a guide wire (not shown) and the other end to be in contact with a conductive collar 50 mounted on the periphery of the insulation spindle 5. In the base 4, the conductive pieces 63 and 64 are located at a higher level and the conductive piece 65 is located at a lower level. The conductive collar 50 is provided with a first contact tab 53 and a second contact tab 54, both of which extend from the bottom of the conductive collar 50 to the lower level in addition to a third contact tab 55 which extends from the bottom of the conductive collar 50 to the higher level. Within the periphery of the insulation spindle 5 are formed three recesses of appropriate depths for respectively accommodating the contact tabs 53, 54 and 55 so that the periphery of the spindle assembly including the insulation spindle 5 and the conductive collar 50 can constitute a cylindrical surface for contact with the conductive pieces 63, 64 and 65. The contact portion 52 located at the bottom of the insulation spindle 5 is pressed against the contact piece 62 which is located at the bottom of the space 41 and connected with the conductive piece 61.

As shown in FIG. 6, the speed change of a ceiling fan incorporating the pull switch shown in FIG. 5 can be accomplished by use of the conductive spindle assembly embodying the present invention. The conductive pieces 63 and 64 are located at a higher level while the contact piece 65 is located at a lower level. In the position shown in FIG. 6-*a*, the conductive piece 61 is in conduction with the contact pieces 63 and 65. In FIG. 6-*b*, the contact piece 61 is in conduction with the contact pieces 64 and 65. In FIG. 6-*c*, the conductive piece 61 is in conduction with the contact piece 65. In FIG. 6-*d*, the conductive piece 61 in not in conduction with any other contact pieces.

Figure 1:
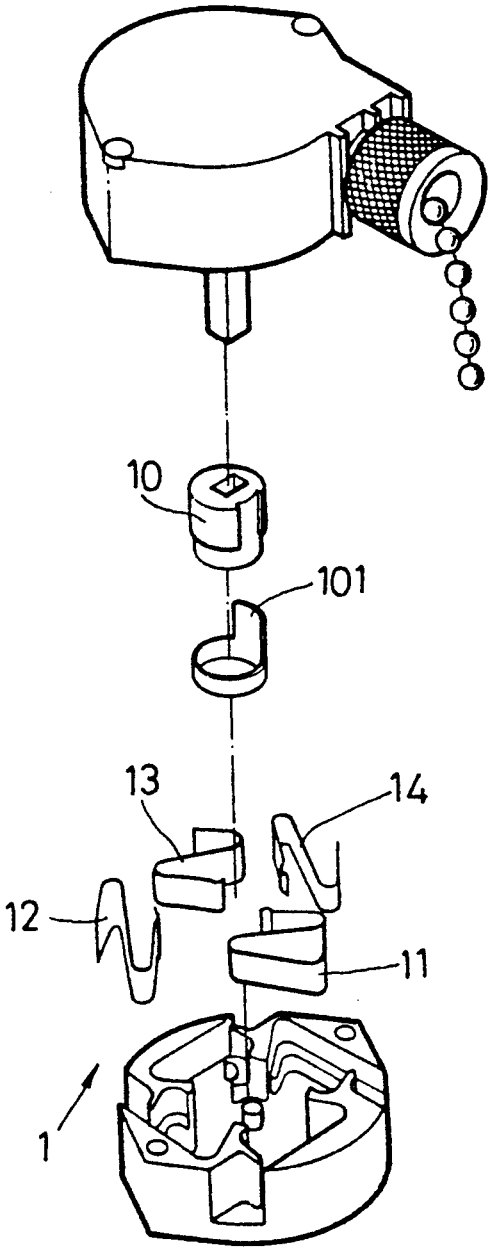
FIG. 1 PRIOR ART
FIG. 1 is an exploded view showing the first conventional pull switch.

Referring to FIG. 7, if the conductive piece 61 as shown in FIG. 5 is used in place of the conductive piece 11 shown in FIG. 1, the conductive piece 61 can be in contact with one of the conductive pieces 12, 13 and 14 so that it can be in conduction with the capacitors of different capacitances to bring about the speed changes. In view of the structure of the conductive collar 50 and of the insulation spindle 5 in conjunction with the conductive pieces 12, 13 and 14 which are disposed at the higher level, FIG. 7-*a* shows that the conductive piece 61 is in conduction with the conductive piece 12 by the contact piece 62. In the position shown in FIG. 7-*b*, the conductive piece 61 is in conduction with the conductive piece 13 when the insulation spindle 5 together with the conductive collar is turned 90 degrees from the position shown in FIG. 7-*a*. When the insulation spindle 5 together with the conductive collar 50 is turned again to the position shown in FIG. 6-*c*, the conductive piece 61 is in conduction with the conductive piece 14. When the insulation spindle 5 together with the conductive collar 50 is turned further to the position shown in FIG. 6-*d*, the conductive piece 61 is in conduction with no any other conductive pieces, thereby bringing about a disconnection position.

Figure 3:
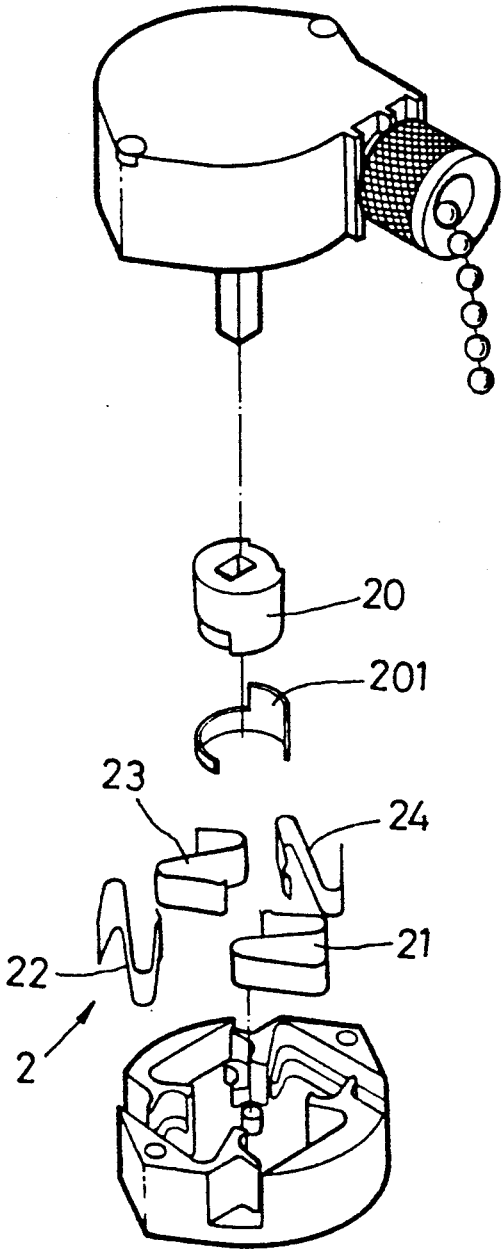
FIG. 3 PRIOR ART
FIG. 3 is an exploded view showing the second conventional pull switch.

If the insulation spindle 20 and conductive collar 201 shown in FIG. 3 are replaced by the insulation spindle 5 and conductive collar 50 in accordance with the invention, then the speed changes can be achieved in the following manner: In the position shown in FIG. 8-*a*, the conductive piece 21 is in conduction with the conductive piece 23. In FIG. 8-*b*, the conductive piece 21 is in conduction with the conductive pieces 22 and 24. In FIG. 8-*c*, the conductive piece 21 is in conduction with the conductive piece 22. In FIG. 8-*d*, the conductive piece 21 is not in conduction with any other conductive pieces.

What is claimed is:

1. A conductive spindle assembly for a pull switch comprising:

(a) an insulation spindle having three vertically extending recesses formed within a periphery thereof; and, (b) a conductive collar for matingly engaging said insulation spindle, said conductive collar having a conductive base portion and first, second, and third vertically extending conductive contact tabs extending therefrom, said first and second conductive contact tabs being angularly spaced each from the other and having a first vertical extension above said base portion, said third conductive contact tab being angularly spaced from said first and second conductive contact tabs and having a second vertical extension above said base portion greater than said first vertical extension of said first and second conductive contact tabs, each of said conductive contact tabs insertable into a respective recess formed in said insulation spindle to form a combined structure having a substantially continuous cylindrical surface.

2. The conductive spindle assembly as recited in claim 1 further including a contact piece member having a contact portion matingly engaged with said base portion and a wire retaining portion connected to said contact portion.

* * * * *